United States Patent [19]

Stout

[11] Patent Number: 4,557,331

[45] Date of Patent: Dec. 10, 1985

[54] WELL PERFORATING METHOD AND APPARATUS

[75] Inventor: Gregg W. Stout, Montgomery, Tex.

[73] Assignee: Baker Oil Tools, Inc., Orange, Calif.

[21] Appl. No.: 551,764

[22] Filed: Nov. 14, 1983

[51] Int. Cl.[4] ..... E21B 34/08; E21B 34/14; E21B 43/11

[52] U.S. Cl. ..... 166/297; 166/55; 166/386; 166/317; 166/318; 175/4.56

[58] Field of Search ..... 166/297, 317, 318, 319, 166/321, 323, 55, 55.1, 386; 175/4.52, 4.56

[56] References Cited

U.S. PATENT DOCUMENTS

| | | | |
|---|---|---|---|
| 3,029,875 | 4/1962 | Moller | 166/317 |
| 3,353,609 | 11/1967 | Jensen | 166/317 X |
| 3,831,680 | 8/1974 | Edwards et al. | 166/317 X |
| 3,980,134 | 9/1976 | Amancharla | 166/317 X |
| 4,062,406 | 12/1977 | Akkerman et al. | 166/323 |
| 4,151,881 | 5/1979 | Armstrong | 166/386 X |
| 4,299,287 | 11/1981 | Vann et al. | 166/297 |
| 4,445,571 | 5/1984 | Hushbeck | 166/317 |
| 4,484,632 | 11/1984 | Vann | 166/297 |

*Primary Examiner*—Stephen J. Novosad

*Attorney, Agent, or Firm*—Norvell & Associates

[57] ABSTRACT

A method and apparatus for effecting the perforation of a well casing and the adjoining production formation comprises a tubular housing communicating between a perforating gun housing and the lower end of a tubular string. The perforating gun housing which is adapted to be carriable by the tubular string contains an impact actuated firing head and the tubular housing contains a port normally closed by sleeve valve. The valve is biased towards an open position but is selectively secured in its closed position by a frangible restraining mechanism which extends into the free fall path of a detonating bar dropped through the tubular tool string and is removed by the detonating bar to initiate the opening of the port sleeve valve prior to impacting the firing head. In a modification, the sleeve valve is shifted to its open position by fluid pressure produced in the casing annulus subsequent to the firing of the perforating gun.

20 Claims, 12 Drawing Figures

WELL PERFORATING METHOD AND APPARATUS

BACKGROUND OF THE INVENTION

History of the Prior Art

There are many production formations encountered in the drilling of modern oil wells wherein it is desirable to effect the perforating of the casing and the adjoining production formation in an "underbalanced" condition, i.e., where the fluid pressure within the casing immediately adjacent the production formation, and the tubular string connected to such casing region, are maintained at a substantially lower fluid pressure than the anticipated fluid pressure of the production formation. When the perforating gun is fired under these conditions, the production fluid flows rapidly through the resulting perforations into the casing and up the tubular string, carrying with it all debris resulting from the perforating operation, hence cleaning the fractures in the perforated formation for more efficient production flow when the well is completed.

In order to efficiently utilize the underbalanced perforating, a packer is generally run into the well on a tubular string and set immediately above the region of the well casing to be perforated. The perforating gun is suspended from the packer by a tubular string which is fluid connected to the tubular work string. Other tools, such as chemical treatment, washing and/or gravel packing tools, may be connected in the same tool string either above or below the packer. In any event, the assembled tool string is run into the well with an essentially dry condition existing in the tool string, thus assuring that the fluid pressure in the tool string is substantially below that anticipated to exist in the formation to be perforated. To permit the free flow of production fluid from the perforated formation, it is necessary that radial ports be opened in the tubular string below the packer and above the perforating gun. It has previously been proposed, for example, in U.S. Pat. No. 4,151,880 (Vann), that a radially ported, wire line actuated sleeve valve be mounted in this position.

The utilization of a wire line actuated valve necessarily introduces delay in effecting the opening of the radial ports in the tubing string, thus delaying the initial flow of production fluid from the perforated formation. U.S. Pat. No. 4,299,287 (Vann) proposes to use the freely falling detonating bar to shift the sleeve valve. This can result in slowing the speed of the detonating bar to a level insufficient to fire the gun.

SUMMARY OF THE INVENTION

This invention provides a method and apparatus for effecting the perforating of a well casing and the adjoining production formation in an underbalanced condition wherein the radially ported sleeve valve disposed between a packer and a perforating gun is automatically opened by the passing therethrough of a free-falling detonating bar for the perforating gun, without extracting any significant amount of kinetic energy from such detonating bar. It is thus assured that the radial ports are fully opened immediately subsequent to the firing of the perforating gun, thus permitting unimpeded fluid flow through the newly formed perforations and up through the tubular string upon which the perforating gun is mounted.

More specifically, the radially ported sleeve valve embodying this invention comprises a housing having radial ports formed therein which are closed in the run-in position of the tool by an axially shiftable sleeve valve. In one modification, the sleeve valve is spring biased to its opening position with respect to the ports but is restrained in its port closing position by a latching mechanism which has a portion thereof extending into the path of the freely-falling detonating bar. The impact of the detonating bar with the inwardly projecting portion of the latching mechanism effects the tripping of the latching mechanism and the release of the sleeve valve to move under its spring bias to its port opening position, thus assuring that the radial ports are immediately opened for flow of formation fluid from the newly perforated formation immediately subsequent to the perforating operation.

In the one embodiment of the invention, the restraining mechanism for latching the sleeve valve in its port closing position comprises a frangible barrier, such as a tempered glass disc which is held in a transverse position across the bore of the tool and, in such position, maintains the latching mechanism in its engaged position with the sleeve valve, thus holding the sleeve valve in its port closing position. A shattering of the glass disc by the passage of the detonating bar therethrough absorbs very little kinetic energy from the detonating bar, yet is effective to release the latching mechanism and initiate the movement of the sleeve valve to its port opening position under the influence of its spring bias.

In another embodiment of the invention, the restraining mechanism for latching the sleeve valve in its port closing position comprises a pair of cooperating collets which are disposed in axially spaced relationship within the tubular housing. The upper collet holds the sleeve valve in its closed position with respect to the radial ports. The latching heads effecting this holding action are restrained in their position by the ring portion of a lower collet having downwardly extending, peripherally spaced spring arms with enlarged head portions projecting partially into the free-fall path of the detonating bar. A shear pin between the ring portion of the lower collet and the housing maintains the collets in their latching relationship with respect to the sleeve valve.

Upon impact of the detonating bar with the latching heads of the lower collet, the shear pins are sheared and the lower collet shifted downwardly a slight distance to release the latching heads of the upper collet. The differential pressure existing between the casing annulus in the vicinity of the housing and the bore of the housing is then effective upon the sleeve valve to urge the sleeve downardly to a port opening position, thus permitting the formation fluids to flow freely through the newly formed perforations and upwardly through the tool string.

Further advantages of the invention will be readily apparent to those skilled in the art from the following detailed description, taken in conjunction with the annexed sheets of drawings on which is shown two preferred embodiments of the invention.

DESCRIPTION OF THE PREFERRED EMBODIMENTS

Figures 1A, 1B, 1C:
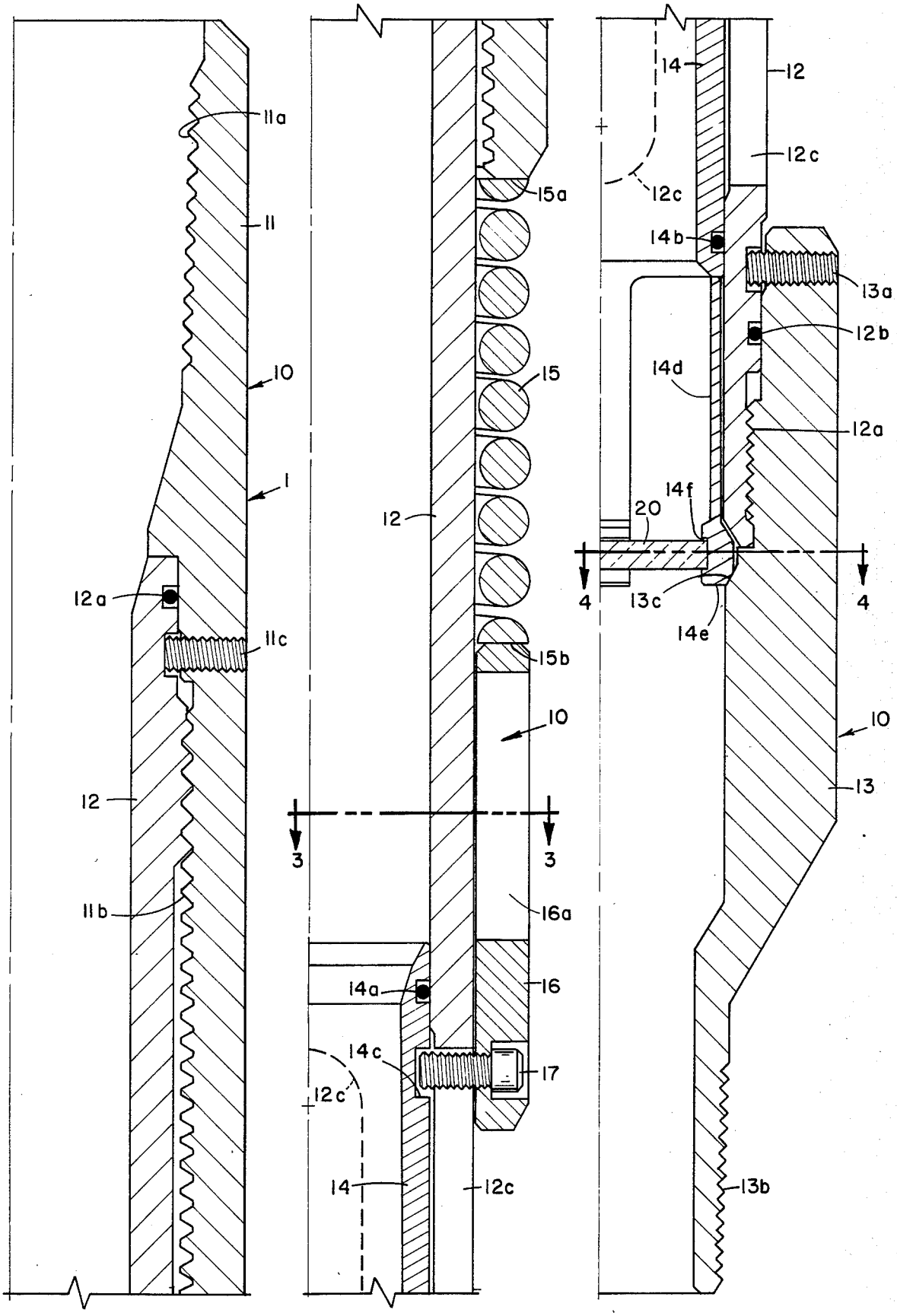
FIGS. 1A, 1B and 1C collectively constitute a vertical, quarter-sectional view of a valve for connection in a tubular string immediately above a perforating gun to permit the firing of the gun in an underbalanced pressure condition with respect to the production formation, with the components of the valve mechanism being shown in their run-in position.

Referring to Figs. 1A–1C, the method of this invention is practiced through the insertion of a valving tool 1 in series relationship between a tubular string (not shown) and the top end of a conventional impact actuated perforating gun, which also is not shown.

The valving tool 10 comprises a housing 10 fabricated by the threaded assemblage of three elements, namely, an upper housing 11, an intermediate housing 12 and a lower housing 13. Upper housing 11 is provided with internal threads **11*a* for conventional connection to the end of the tubular string. The lower end of upper housing 11 is internally threaded as indicated at 11*b* and the intermediate housing 12 is secured thereto. An O-ring seal 12*a* seals the threaded connection and a set screw 11*c*** effects the locking of the threaded connection.

The lower end of the intermediate housing 12 is provided with threads **12*a* for connection to the lower housing 13. An O-ring seal 12*b* seals the threaded connection and a set screw 13*a* effects securement of the threaded connection. The lower end of the lower housing 13 is provided with external threads 13*b*** for conventional sealed connection to the housing of a perforating gun (not shown).

The intermediate portion of the middle housing 12 is provided with a plurality of peripherally spaced, axially extending fluid flow passages **12*c* and a sliding sleeve valve having spaced O-rings 14*a* and 14*b* overlying passages 12*c*** to prevent the flow of fluid therethrough.

The sliding sleeve valve 14 is, however, biased to an open position relative to the fluid passage ports **12*c* by a spring 15. The top end 15*a* of spring 15 abuts the bottom end of the upper housing 11, while the bottom end 15*b* of spring 15 abuts the top end of a force transfer or actuating sleeve 16 which is slidably mounted on the exterior of the intermediate housing 12. Sleeve 16 is of skeletonized configuration, having only three axial ribs 16*a* in its midsection. The actuating sleeve 16 is secured to the valve sleeve 12 for axial movement by a plurality of peripherally spaced bolts 17 which pass through the axially extending fluid passage ports 12*c* and engage an annular recess 14*c* provided in the valve sleeve 14. Thus, any movements of the sleeve 16 produced by the compressed spring 15 are immediately transferred to the valve sleeve 14**.

Figures 2A, 2B, 2C:
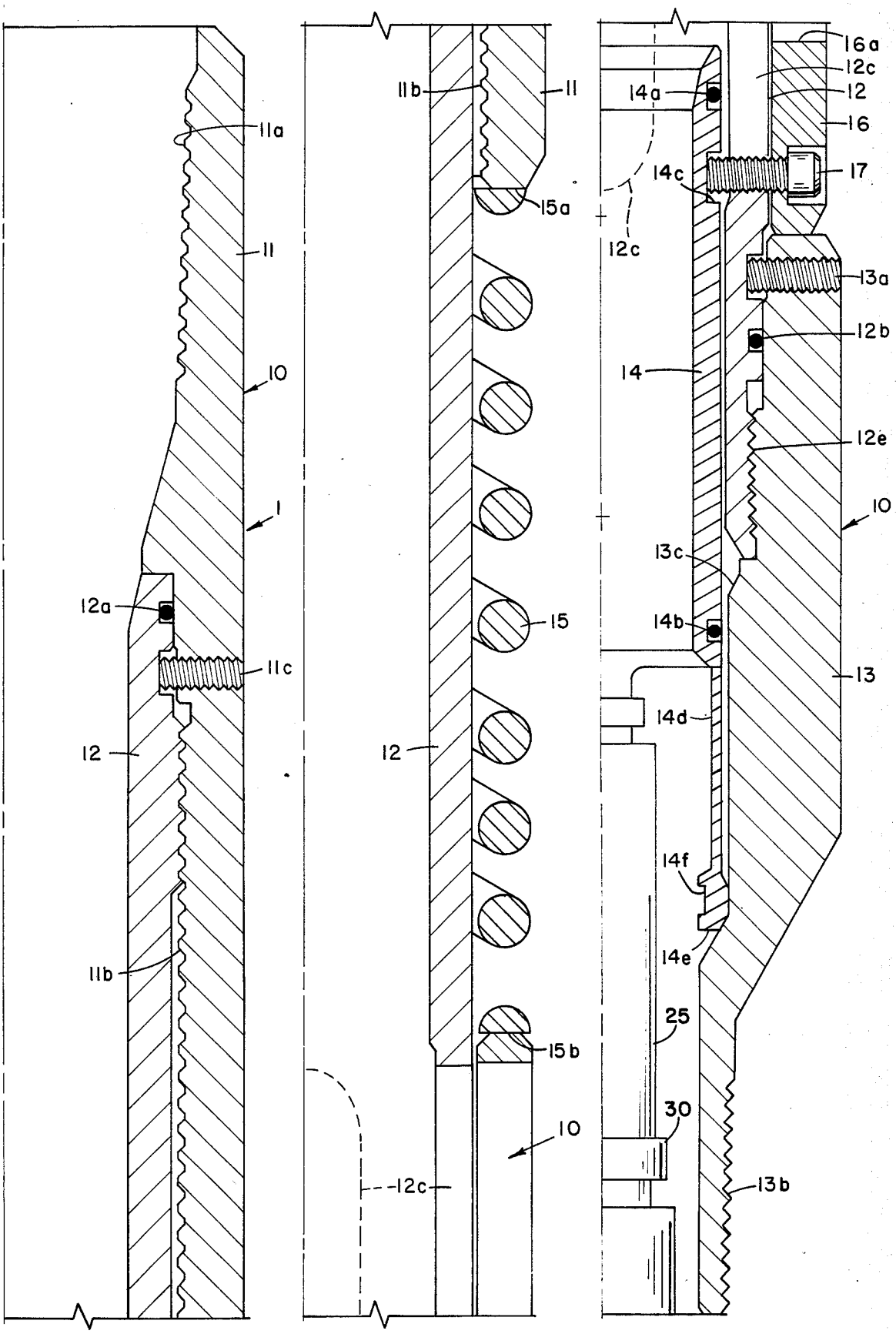
FIGS. 2A, 2B and 2C are views respectively similar to FIGS. 1A, 1B and 1C, but illustrate the position of the components following the passage of a detonating bar therethrough to fire the perforating gun.
Figure 3:
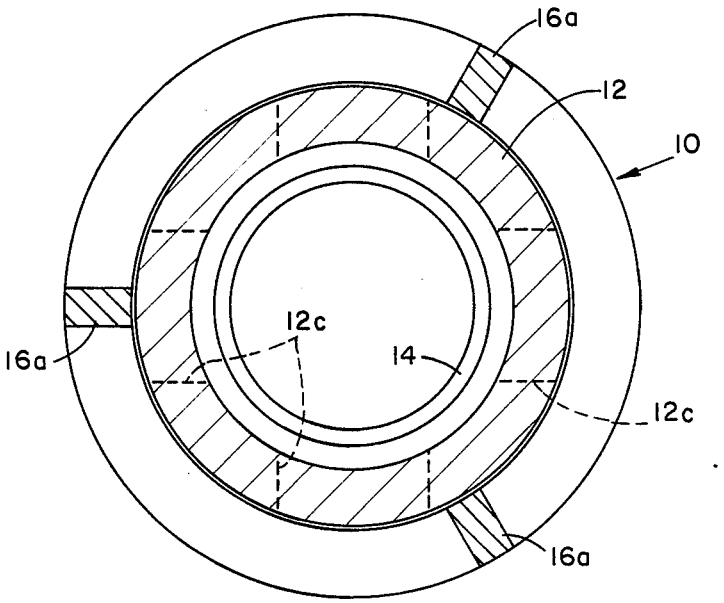
FIG. 3 is a sectional view taken on the plane 3—3 of FIG. 1B.
Figure 4:
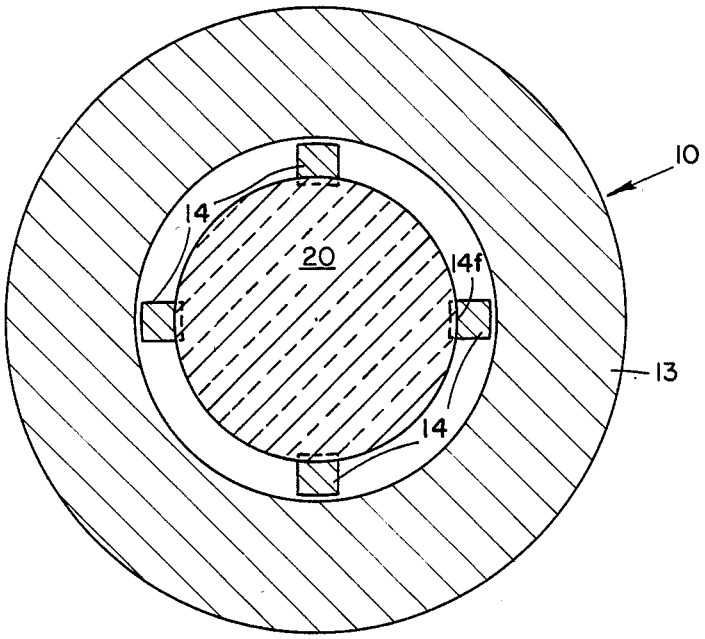
FIG. 4 is a sectional view taken on the plane 4—4 of FIG. 1C.

The lower end of valve sleeve 14 is formed with a plurality of peripherally spaced, axially extending collet arms **14*d*, each of which terminates in an enlarged head portion 14*e*. Collet arms 14*d* are constructed with an inherent radially inward spring bias, but are pushed radially outwardly and maintained in latching engagement with an internal shoulder 13*c* formed on the lower housing element 13 by a frangible retention member 20 which extends across the internal bore of the valve sleeve 14. Retention barrier 20 preferably comprises a member that is readily frangible when impacted by the downwardly falling detonating bar 25 (FIG. 2C). A tempered glass disc makes an admirable retention barrier since the energy required to shatter the disc is minimal compared to the kinetic energy contained within the falling detonating bar 25. Furthermore, the fact that the glass disc is tempered insures that when it breaks, it will shatter into literally hundreds of small pieces which will not in any way impede the impact blow transferred to the firing mechanism of the perforating gun by the falling detonating bar 25. The frangible retention disc 20 is mounted within an internal slot 14*f* provided in the enlarged head portion 14*e* of each collet arm 14*d***.

As best shown in FIGS. 2B and 2C, the apparatus of the invention is operated entirely automatically by the downward movement of the detonating bar 25. As soon as the retention barrier 20 is broken by the detonating bar 25, the collet arms **14*d* spring inwardly and release from the latching surface 13*c* provided on the lower housing 13, thus freeing the valve sleeve 14 and the spring pressed actuating sleeve 16 to move downwardly under the bias of the compressed spring 15**.

In summary, therefore, the method of this invention contemplates the compression of the spring 15 by the actuating sleeve 16 during the intial assemblage of the barrier retention disc 20 between the ends of the collet arms **14*d*. The spring loaded tool is then assembled in the tubing string immediately above the perforating gun and the assemblage is run into the well on a tubing string. When the perforating gun is positioned opposite the production formation to be perforated, the packer (not shown) carried by the tubing string is set and the pressure within the tubing string, hence within the bore of the tool 10, is reduced to a level below that anticipated for the production fluids contained in the formation to be perforated. The tubing string may be run in dry or just partially filled with fluid. The detonating bar 25 is then dropped and shatters the retention barrier 20, thus releasing the sleeve valve 14 for downward movement to its open position wherein fluid may freely pass from the interior of the housing 10 through the openings formed between ribs 16*a* of the actuating sleeve 16 and the radial ports 12*c***. Thus, coincidentially with the firing of the perforating gun, a direct fluid passage is opened to the interior of the tubing string, permitting unrestricted flow of the formation fluids through the newly formed perforations and upwardly into the tubing string. Such flow is fairly rapid due to the underbalanced pressure condition existing in the tubing string at the instant of perforating, and thus the debris inherently encountered in the perforating operation is washed from the perforations and does not impede future production from the perforated formation.

Figure 5A:
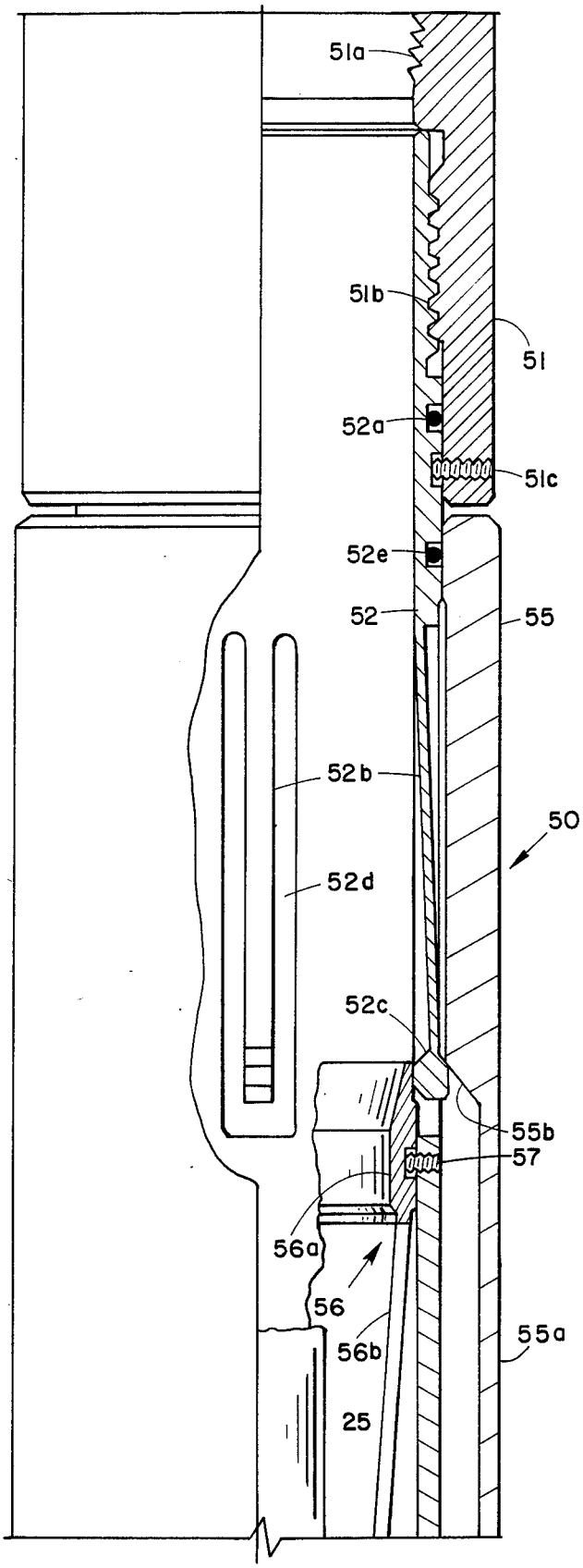
FIGS. 5A and 5B collectively constitute a vertical, quarter-sectional view of a modified valve embodying this invention wherein fluid pressure is utilized to effect the shifting of the valve following the release of the latching mechanism by a free-falling detonating bar; in these figures, the components of the valve are shown in their run-in position.
Figure 5B:
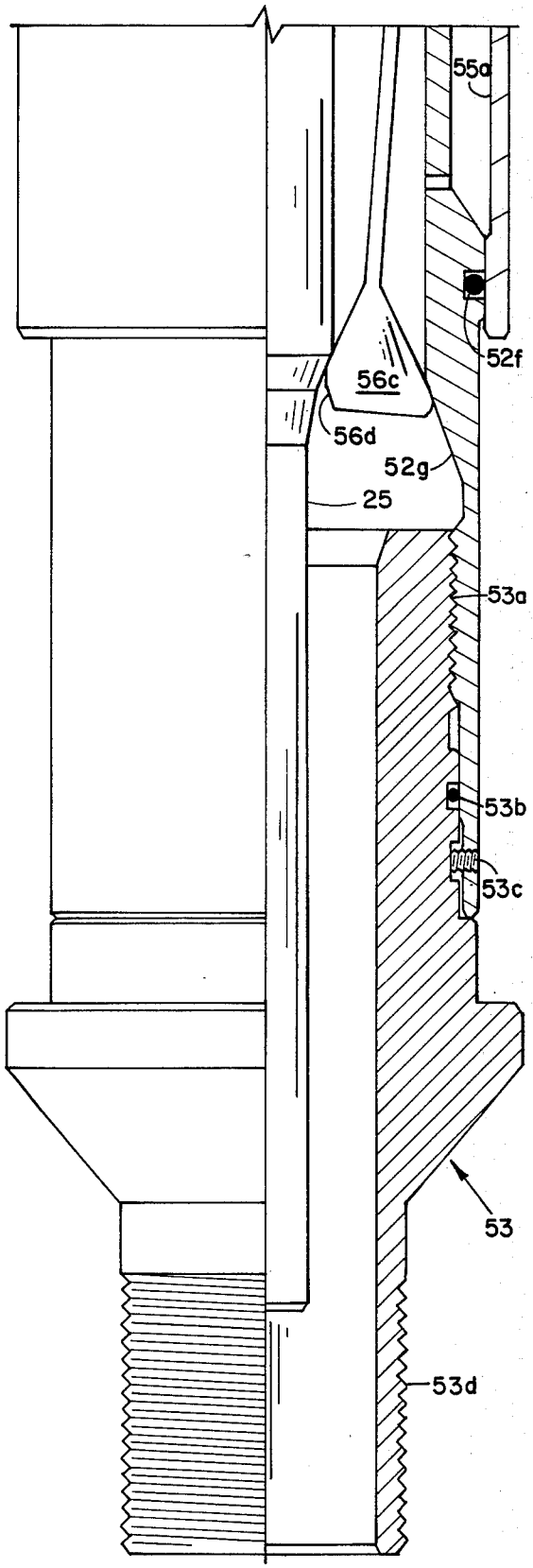

Referring now to FIGS. 5A and 5B, there is shown a modified apparatus embodying this invention. In this embodiment, a valve housing 50 is provided comprising an upper connecting sub portion 51, an intermediate tubular portion 52 and a lower connecting sub portion 53. The upper sub portion 51 is provided with internal threads 51*a* at its upper end for connection to a tubular tool string which generally includes a packer and may include other tools, such as washer, chemical treatment apparatus, and/or gravel packing apparatus. The upper connecting sub portion 51 is connected by threads 51*b* to the top end of the intermediate portion 52. The threaded connection is sealed by an O-ring 52*a* and secured by a set screw 51*c*.

The intermediate housing portion 52 is connected by threads 53*a* to the lower connecting sub portion 53. This threaded connection is sealed by an O-ring 53*b* and secured by a set screw 53*c*. The lower extremity of the lower connecting sub 53 is provided with threads 53*d* for conventional sealed connection to the housing of a perforating gun (not shown) having an impact actuated primer which is detonated by dropping thereon of a detonating bar 25, which is shown in intermediate positions in FIGS. 5B and 6B.

The medial portion of the intermediate housing portion 52 is machined to define a plurality of peripherally spaced, axially extending collet arms 52*b*, each of which terminates in an enlarged head portion 52*c*. Each collet arm 52*b* is surrounded by a space 52*d* which comprises a radial fluid passage or port for the entry of formation fluids into the interior of the tubular tool string, in a manner that will be hereinafter described.

The radial ports 52*d* are normally sealed by a sleeve valve 55 which snugly surrounds the periphery of the intermediate housing portion 52 and is sealably engaged by an O-ring 52*e* seal in the upper portion of the intermediate housing 52 above the radial ports 52*d*, and by an O-ring seal 52*f* in a portion of the intermediate housing 52 located below the radial ports 52*d*. It should be noted that the diameter of the O-ring seal 52*f* is substantially greater than that of the O-ring 52*e*, and the sleeve valve 55 has a reduced thickness lower portion 55*a* to cooperate with the larger diameter O-ring 52*f*.

Sleeve valve 55 is retained in its sealing position relative to the radial ports 52*d* by the enlarged head portions 52*c* of the collet arms 52*b*. Such head portions engage a downwardly sloped surface 55*b* communicating between the upper thickwalled portion of the sleeve 55 and the lower thinwalled portion 55*a*. In turn, the heads 52*c* of the collet arms 52*b* are held in their latching relationship with respect to the valve sleeve 55 by the ring portion 56*a* of a collet 56 which is mounted within the bore of the intermediate housing portion 52. Collet 56 has a plurality of peripherally spaced, downwardly extending spring arms 56*b*, each of which terminates in an enlarged head portion 56*c*. The extreme inner portion of 56*d* of each enlarged head portion 56*c* projects into the path of the detonating bar 25.

The collet 56 is releasably secured in its run-in position illustrated in FIG. 5A by a plurality of shear screws 57 in the wall of housing 52. The intermediate housing portion 52 is provided with an annular recess 52*g* which will receive the enlarged collet head portions 56*c* upon downward movement of the collet 56 subsequent to shearing of the shear pins 57. Such downward movement is imparted by the passage of the detonating bar 25 through the bore of the housing 50. It should be noted that the energy extracted from the detonating bar 25 is only that sufficient to effect the shearing of pins 57 and the movement of the collet 56 to its lower position illustrated in FIG. 6B. None of the kinetic energy of the detonating bar 25 is employed to effect the movement of the valve sleeve 55 to its port opening position.

Figure 6A:
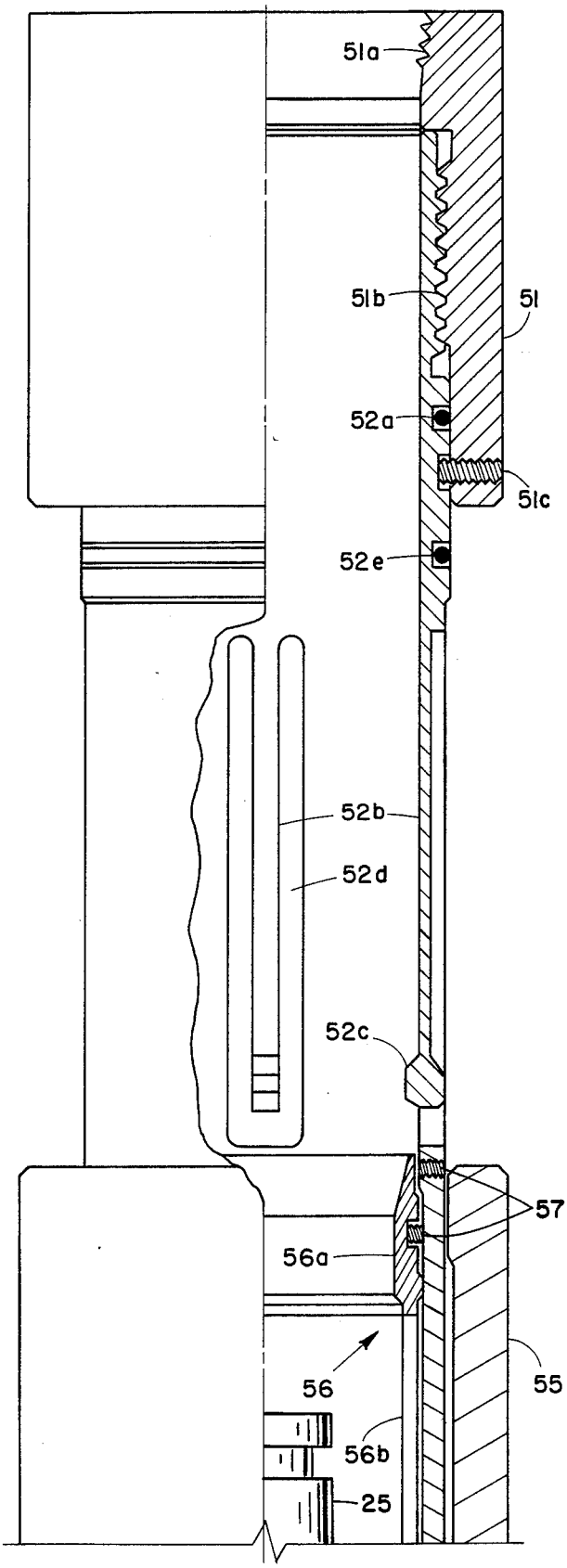
FIGS. 6A and 6B collectively comprise views similar to FIGS. 5A and 5B but showing the elements of the valve in their open port position following the firing of the perforating gun.
Figure 6B:
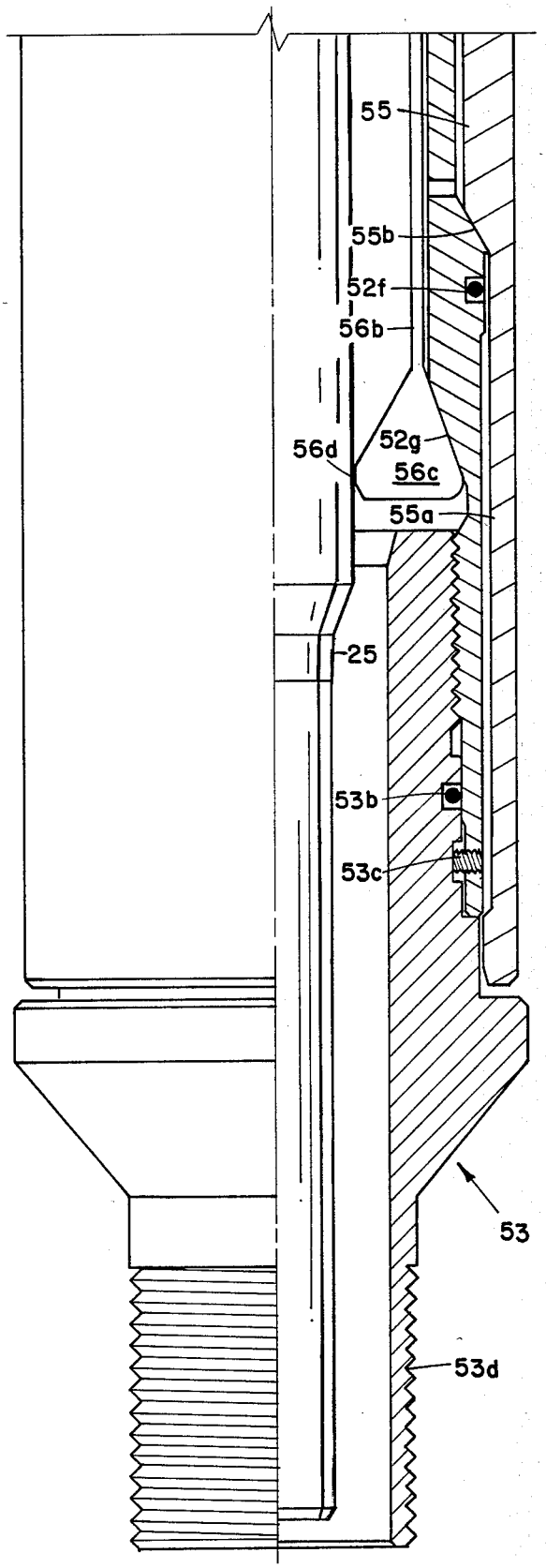

The downward movement of the valve sleeve 55 to its port opening position is accomplished entirely by fluid pressure. After the lower collet 56 moves downwardly, the collet arms 52*b* of upper collet 52 are free to be cammed inwardly by the inclined surface 55*b* acting on the bulbous heads 52*c*. The valve sleeve 55 is always subjected to the fluid pressure existing in the casing annulus surrounding the housing 50. This fluid pressure is substantially in excess of the fluid pressure within the bore of the housing 50 for the reason that such bore is deliberately maintained dry or is only partially filled with fluid and the tubing string fluid pressure is thus substantially less than the anticipated fluid pressure of the formation to be perforated. Additionally, the discharge of the perforating gun will, as is well known to those skilled in the art, produce a charge of compressed gases which will also augment the fluid pressure existing in the casing annulus adjacent the valve sleeve 55. Accordingly, because of the differential areas of the valve sleeve 55 exposed to the casing annulus pressure and the internal bore pressures, the valve sleeve 55 will be forced downwardly to its open position, as illustrated in FIG. 6B, thus exposing the radial ports 52*d* and permitting unrestricted flow of fluid from the newly formed formations through such ports and upwardly through the tool string, due to the underbalanced condition existing at the time of perforating.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Well perforating apparatus comprising a tubular housing having means on its upper end for connecting to a tubular tool string; means on the lower end of said tubular housing for communicating to a perforating gun housing containing an impact actuated firing head; port means in said tubular housing; shiftable valve means for opening and closing said port means; means for biasing said shiftable valve means to a port opening position; means for securing said shiftable valve means in a port closing position; and restraining means resisting movement of said securing means from said port closing position; said restraining means being disposed in the free fall path of a detonating means transmitted through the tubular tool string and removed thereby, whereby the detonating bar initiates the opening of said radial port means prior to impacting said firing head.

2. The apparatus defined in claim 1 wherein said shiftable valve means comprises a sleeve axially shiftable on said tubular housing and said means for biasing said shiftable valve means comprises a spring element surrounding said tubular housing and abutting said sleeve.

3. The apparatus of claim 1 wherein said securing means comprises a collet coaxially disposed relative to said tubular housing and having spring arms resiliently expandable into latching engagement with the lower end of said tubular housing; and said restraining means comprises a frangible barrier disposed in the path of the detonating bar and holding said collet arms in a radially expanded position of engagement with said lower end of said tubular housing to comprise a lower portion of said shiftable valve means.

4. The apparatus defined in claim 3 wherein said shiftable valve means comprises a sleeve axially shiftable on said tubular housing and said means for biasing said shiftable valve means comprises a spring surrounding said tubular housing and abutting said sleeve.

5. The apparatus of claim 3 wherein said frangible barrier comprises a disc element comprising tempered glass.

6. Well perforating apparatus comprising a tubular housing having means on its upper end for communicable extension to a tool string and means on its lower end for communicable extension to a perforating gun having an impact actuated firing head; port means in said tubular housing; first means for opening and closing said port means; securing means for securing said first means in a port closing position; restraining means for resisting movement of said securing means from said port closing position; said restraining means projecting into the free fall path of movement of a detonating means transmitted through the tubular tool string and being shiftable thereby to release said securing means; and means other than the detonating means for axially shifting said first means to a port opening position subsequent to passage thereacross of the detonating means.

7. The apparatus of claim 6 wherein said securing means comprises a collet having peripherally spaced latching arms held by said restraining means in engagement with said valve sleeve to prevent movement thereof to said port opening position.

8. Well perforating apparatus comprising a tubular housing having means on its upper end for communicable extension to a tool string, and means on its lower end for communicable extension to a perforating gun having an impact actuated firing head; port means in said tubular housing; a sleeve valve for opening and closing said port means; securing means for securing said valve sleeve in a port closing position; restraining means for resisting movement of said securing means from said port closing position; said restraining means projecting into the free fall path of movement of detonating means transmitted through the tubular tool string and being shiftable thereby to release said securing means; and means responsive to the fluid pressure produced in the casing annulus adjacent said housing for shifting said sleeve valve to its said open position relative to said port means subsequent to the firing of the perforating gun.

9. The apparatus of claim 8 wherein said means responsive to the fluid pressure produced in the casing annulus comprises a first piston surface on said valve sleeve exposed to said annulus fluid pressure and an opposed piston surface exposed to a lower fluid pressure within said housing.

10. The apparatus of claim 8 wherein said restraining means comprises the ring portion of a collet; shearable means securing said ring portion in said position preventing movement of said securing means from said port closing position; said collet having a plurality of peripherally spaced arms, each arm terminating in a head portion projecting partially into said free fall path of movement of the detonating means, thereby shearing said shearable means and shifting said collet downwardly to free said securing means.

11. The apparatus of claim 7 wherein said securing means comprises a collet having peripherally spaced latching arms held by said restraining means in engagement with said valve sleeve to prevent movement thereof to said port opening position.

12. The apparatus of claim 11 wherein said means responsive to the fluid pressure produced in the casing annulus comprises a first piston surface on said valve sleeve exposed to said annulus fluid pressure and an opposed piston surface exposed to a lower fluid pressure within said housing.

13. The apparatus of claim 11 wherein said restraining means comprises the ring portion of a collet; shearable means securing said ring portion in said position preventing movement of said latching means from said port closing position; said collet having a plurality of peripherally spaced arms, each arm terminating in a head portion projecting partially into said free fall path of movement of the detonating means, thereby shearing said shearable means and shifting said collet downwardly to free said latching means.

14. The method of underbalance perforating a well casing and adjacent formation by an impact fired perforating gun which is adapted to be carriable by a tubing string, impact fired, perforating gun, said tubing string having an axially shiftable valve adapted to open and close port means in said tubing string immediately above said perforating gun; comprising the steps of:

shifting said valve to said port closing position against a bias and securing said valve in said closed position by securing means latch having a movement preventing portion projecting into the tubing bore;

positioning the perforating gun at the desired location in the casing;

maintaining the fluid pressure in the tubing string adjacent the port means at a level below the anticipated formation fluid pressure; and positioning detonating means through the tubing to trip the securing means and fire the perforating gun, thereby opening said port means for immediate flow of formation fluids up said tubing string.

15. The method of claim 14 wherein a disc of glass constitutes the movement preventing portion of the securing means, said glass disc being shattered by the detonating means without substantially reducing the kinetic energy of the detonating bar.

16. The method of underbalance perforating a well casing and adjacent formation by dropping a detonating bar on a tubing string communicable perforating gun, comprising the steps of:

providing port means in the tubing string above the perforating gun and a shiftable sleeve valve biased to an open position relative to the port means;

latching the sleeve valve in a closed position by a latching mechanism including a latch release operable by the passage of a detonating bar through the tubing string;

positioning the perforating gun at the desired location in the casing;

maintaining the fluid pressure in the tubing string adjacent the port means at a level below the anticipated formation fluid pressure; and dropping a detonating bar through the tubing to trip the latch and fire the perforating gun, thereby opening said port means for immediate flow of formation fluids up said tubing.

17. The method of claim 16 wherein said latch release constitutes a tempered glass mass transversely disposed relative to the path of the detonating bar; said glass mass being breakable by a small portion of the kinetic energy of said detonating bar.

18. The method of underbalance perforating a well casing and adjacent formation by a tubing string communicable, impact fired, perforating gun, said tubing string having an axially shiftable valve adapted to open and close radial ports in said tubing immediately above said perforating gun comprising the steps of:

securing said axially shiftable valve in said port closing position by a shiftable latch mechanism;

maintaining the fluid pressure in the tubing string adjacent the radial ports at a level below the anticipated formation fluid pressure;

dropping a detonating bar through the tubing to shift said latch mechanism out of engagement with said axially shiftable valve; and moving said axially shiftable valve to its port opening position by energy supplied from a source other than the detonating bar.

19. The method of claim 18 wherein the valve shifting energy is derived from compressing a spring when the valve is secured in its port closing position.

20. The method of claim 18 wherein the valve shifting energy is derived from fluid pressure produced in the casing annulus adjacent the shiftable valve subsequent to firing the perforating gun.

* * * * *